US005270505A

United States Patent [19]

Magiera

[11] Patent Number: 5,270,505

[45] Date of Patent: * Dec. 14, 1993

[54] REMOTE CONTROLLED SWITCH/RECEPTACLE

[76] Inventor: Joseph Magiera, 176 Acorn La., Libertyville, Ill. 60048

[ * ] Notice: The portion of the term of this patent subsequent to Jun. 11, 2008 has been disclaimed.

[21] Appl. No.: 825,848

[22] Filed: Jan. 24, 1992

Related U.S. Application Data

[63] Continuation-in-part of Ser. No. 702,454, May 16, 1991, abandoned, which is a continuation of Ser. No. 452,064, Dec. 18, 1989, abandoned.

[51] Int. Cl.[5] ..... H01H 3/00

[52] U.S. Cl. ..... 200/331; 200/337; 200/339; 200/553

[58] Field of Search ..... 200/5 R, 329, 330, 331, 200/337, 339, 529, 538, 540, 561, 553, 554, 557, 558, 562, 563

[56] References Cited

U.S. PATENT DOCUMENTS

| | | | |
|---|---|---|---|
| 2,335,110 | 11/1943 | Dann | 200/5 R |
| 2,614,197 | 10/1952 | Lightfoot | 200/331 |
| 2,659,791 | 11/1953 | Dickinson | 200/331 |
| 2,725,438 | 11/1955 | Bentley | 200/557 |
| 2,962,571 | 11/1960 | Zanichkowsky | 200/553 X |
| 3,024,339 | 3/1962 | Johnson | 200/331 |
| 3,479,478 | 11/1969 | Robbins | 200/553 |
| 3,501,607 | 3/1970 | Tanaka | 200/553 |
| 3,582,584 | 6/1971 | Best | 200/556 |
| 3,939,725 | 2/1976 | Fisher | 200/331 X |
| 4,072,841 | 2/1978 | Corfield | 200/403 |
| 4,091,247 | 5/1978 | Gaber | 200/437 |
| 4,253,004 | 2/1981 | Oka | 200/331 |
| 4,347,417 | 8/1982 | Sorenson | 200/67 G |
| 4,430,534 | 2/1984 | Sorenson | 200/68.3 |
| 4,431,880 | 2/1984 | Ives | 200/315 |
| 4,454,400 | 6/1984 | Sorenson | 200/315 |
| 4,461,938 | 7/1984 | Sorenson | 200/296 |
| 4,488,201 | 12/1984 | Webb et al. | 361/334 |
| 4,489,300 | 12/1984 | Hollenstein et al. | 337/186 |
| 4,620,077 | 10/1986 | Zdanys, Jr. et al. | 200/339 |
| 4,626,638 | 12/1986 | Samples | 200/331 |
| 4,814,554 | 3/1989 | Magiera | 200/6 R |
| 4,922,225 | 5/1990 | Dankert | 200/538 |
| 4,924,047 | 5/1990 | Tsuge | 200/553 |
| 4,939,329 | 7/1990 | Dankert | 200/538 X |
| 4,967,043 | 10/1990 | Killarney | 200/402 |
| 5,023,417 | 6/1991 | Magiera | 200/337 X |

OTHER PUBLICATIONS

"CTS Series 080 AC Switch/Receptacle with Remote Actuator", CTS Corporation, Switch Division, 500 Linne Soad, Paso Robles, Calif. 93446 (4 pages).

*Primary Examiner*—Henry J. Recla
*Assistant Examiner*—Glenn T. Barrett
*Attorney, Agent, or Firm*—Hill, Steadman & Simpson

[57] ABSTRACT

A remotely controlled switch/receptacle assembly has a housing for providing a support which has at least a first section and a second section. A remote actuator has at least one moveable section. A nonlinear motion switch is located in the first section of the housing and has a moveable actuator for making and breaking an electrical connection between at least first and second electrical contacts. A cable connects the moveable section of the remote actuator to the moveable actuator in the nonlinear motion switch. An electrical receptacle is located in the second section of the housing, the receptacle having at least a first electrical prong which has a first end connected to the first electrical contact in the nonlinear motion switch. When the moveable section of the remote actuator is moved, the moveable actuator of the nonlinear motion switch changes from at least one switch position to another switch position, thereby producing a connection or a disconnection between the first and second contacts of the nonlinear motion switch.

12 Claims, 6 Drawing Sheets

FIG. 2
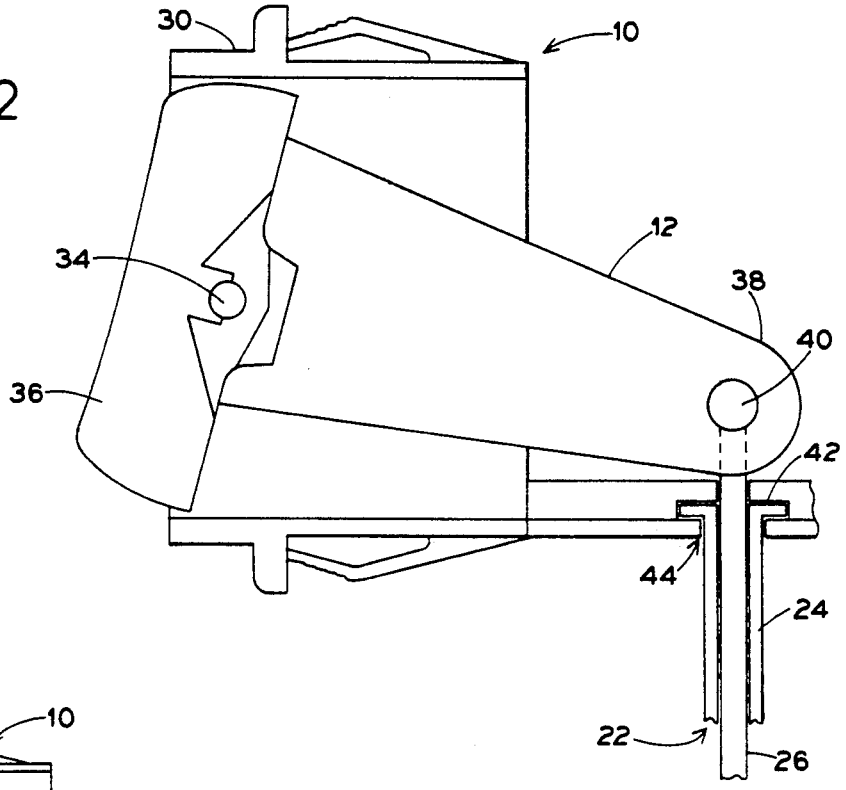
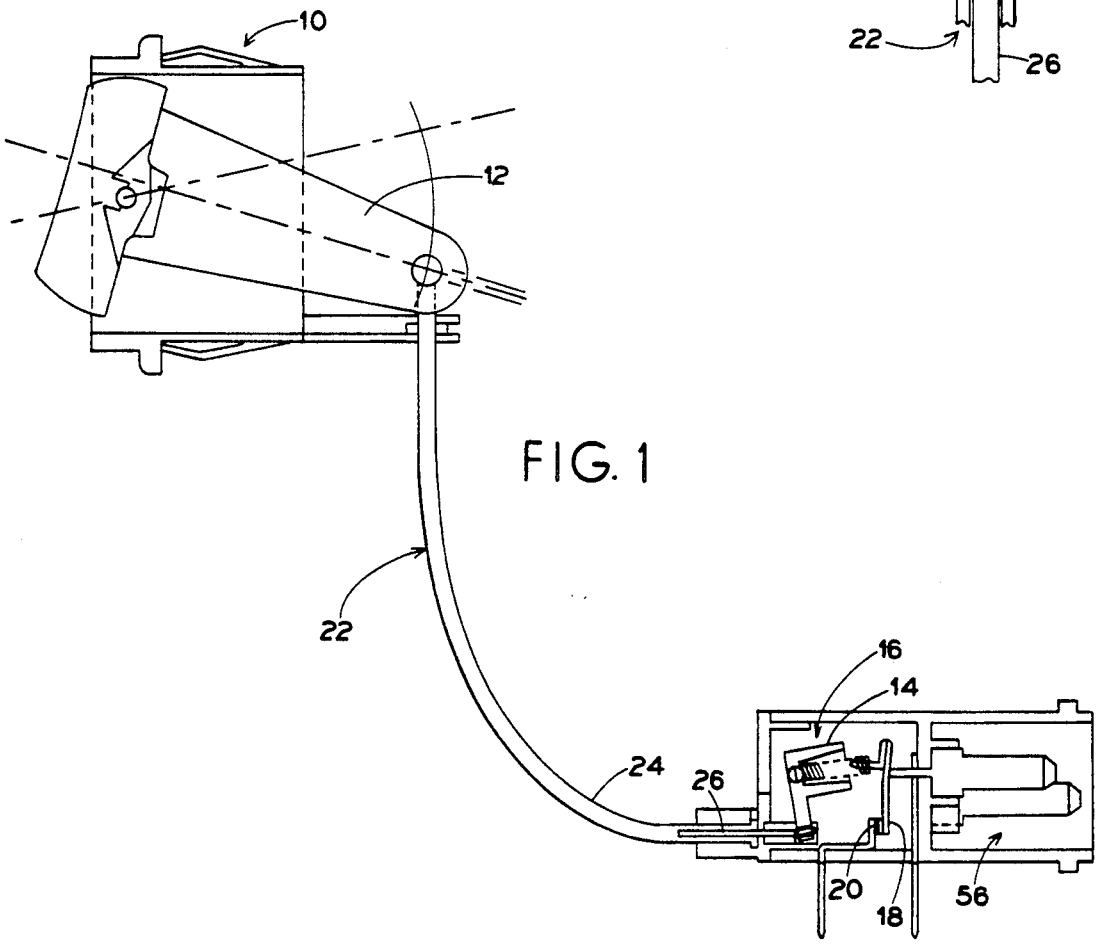
FIG. 1

REMOTE CONTROLLED SWITCH/RECEPTACLE

This is a continuation-in-part of Ser. No. 702,454, filed May 16, 1991 and now abandoned, which is a continuation of Ser. No. 452,064, filed Dec. 18, 1989 and now abandoned.

BACKGROUND OF THE INVENTION

The present invention relates in general to electrical switches and receptacles and, in particular, to a remotely controlled switch/receptacle.

Electrical switches operated by remote actuators are well known in the prior art, as well as switches located in electrical receptacles, for example I.E.C. receptacle. Such combinations of switches and receptacles are typically used in electronic equipment, such as computer equipment. The combination is mounted on the rear of the equipment cabinet and the switch actuator and the receptacle are arranged side-by-side. Operation of the switch is thus inconvenient and the combination requires a large area on the rear of the cabinet. Also, the electrical contacts in the switch are separate from the prongs in the receptacle, the contacts and prongs being connected together by wires for example. However, such relatively long electrical paths are detrimental to radio frequency isolation.

The present invention overcomes these drawbacks in the prior art.

SUMMARY OF THE INVENTION

It is an object of the present invention to provide a switch/receptacle assembly which is remotely actuated.

It is a further object to provide a remotely controlled switch/receptacle which has optimally short internal electrical paths.

These objects are achieved by a remotely controlled switch/receptacle assembly which has a housing for providing a support having at least a first section and a second section. A remote actuator has at least one movable section. A nonlinear motion switch is located in the first section of the housing and has a one piece movable actuator for making and breaking an electrical connection between at least first and second electrical contacts. A cable connects the movable section of the remote actuator to the one piece movable actuator in the nonlinear motion switch. An electrical receptacle is located in the second section of the housing, the receptacle having at least a first electrical prong which has a first end connected to the first electrical contact in the nonlinear motion switch. When the movable section of the remote actuator is moved, the one piece movable actuator of the nonlinear motion switch changes from at least one switch position to another switch position, thereby producing a connection or a disconnection between the first and second contacts of the nonlinear motion switch.

In one embodiment of the remotely controlled switch/receptacle assembly the first and second contacts of the nonlinear motion switch form a first pair of contacts of a plurality of pairs of contacts. The receptacle has at least a corresponding electrical prong connected to a corresponding first contact in each of the pairs of contacts, each of the prongs having its respective first end extending into the first section. The nonlinear motion switch can be a double pole, single throw switch interfaced with a receptacle having at least two electrical prongs. Alternatively, the nonlinear motion switch can be a double pole, double throw-switch interfaced with a receptacle having at least two electrical prongs, the nonlinear motion switch further having a third electrical contact for each pair of contacts, wherein in the switch position disconnecting the first and second electrical contacts, the first and third electrical contacts are connected.

The remote actuator has a body containing the movable section attached thereto at a pivot axis, the movable section having at least a first end removably connected to the cable.

In the preferred embodiment the cable has an outer sheath and an inner connector, a first end of the cable having the outer sheath attached to the body and having the inner connector connected to the first end of the movable section. A second end of the cable is connected to the nonlinear motion switch, the outer sheath being attached to the first section and the inner connector being attached to the one piece movable actuator.

In one embodiment the nonlinear motion switch is a rocker switch.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

FIG. 1 is a schematic depiction of the present invention;

FIG. 2 is a schematic depiction of an actuator used in the FIG. 1 device;

DESCRIPTION OF THE PREFERRED EMBODIMENT

Figure 3:
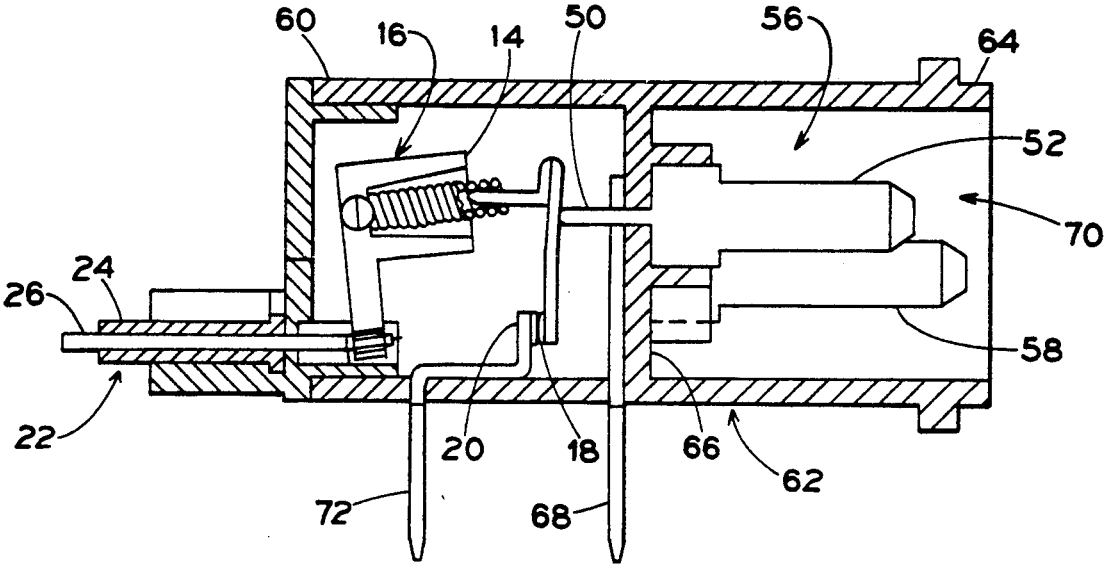
FIG. 3 is a cross-sectional view of an electrical switch in the FIG. 1 device.

The present invention has general applicability, but is most advantageously used in a switching device as depicted in FIG. 1.

A part of the present invention is a switch, which may be a rocker switch of a single or double pole configuration. Such switches are generally referred to as toggle switches. Numerous other types of electrical switches can be utilized in the present invention. For example, a rocker switch having a mechanism of the type disclosed in U.S. Pat. No. 4,814,554 (hereby incorporated by reference) can be utilized. A simplified example of a rocker switch is depicted in FIGS. 1 and 3.

As shown in FIG. 1 the remotely controlled switch/receptacle has a means 10 for actuating having at least one movable section 12. A means for moving or one piece activating assembly 14 is contained in a rocker switch 16. The activating assembly 14 opens and closes the pair of electrical contacts 18, 20. A cable 22 is provided which has an outer sheath 24 and an inner conductor 26. The cable 22 connects the movable section 12 of the means for actuating 10 to the activating assembly 14 of the switch 16. When the movable section 12 of the means for actuating 10 is moved, the activating assembly 14 in the switch 16 changes from one switch position to another switch position.

Referring now to FIG. 2, the means for actuating or actuator 10 in the preferred embodiment has a housing 30. A movable actuator cap 36 is connected to the movable section 12 and pivots about pivot axis 34. An operator can change the position of the actuator 10 by pressing on the up raised portion of the cap 36. On a first end 38 of the movable section 12 an end of the inner conductor 26 of the cable 22 is attached in a pivotable manner at location 40. The outer sheath 24 of the cable 22 is attained to the housing 30. The flange 42 on the end of the cable 22 allows the cable 22 to be attached to the housing 30 of the actuator 10 without the use of any tools, the housing 30 being provided with an open slot 44 for insertion of the cable 22. Also the end of the inner connector 26 can have an enlarged portion which fits into an opening in the first end 38 of the movable section 12 at the pivot location 40. Thus, assembly and disassembly of the cable 22 from the actuator 10 is simple and quick and does not require the use of any tools. Various other ways of connecting the cable 22, both its inner conductor 26 and outer sheath 24, can be envisioned by one skilled in the art.

Figure 4:
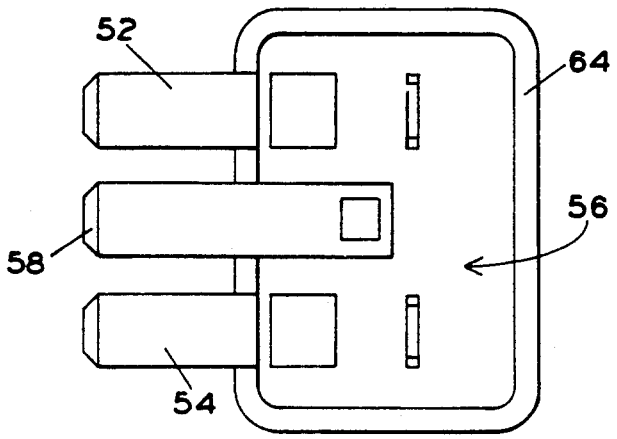
FIG. 4 is a schematic representation of a receptacle used in the FIG. 1 device.

As shown in FIG. 3 the switch used in one embodiment of the present invention is a rocker switch 16. The rocker switch 16 has its first contact 18 connected not only to the one piece movable actuator 14 but also to a first end 50 of a first electrical prong 52 in an electrical receptacle 56. In a typical embodiment the receptacle 56 has first and second electrical prongs 52. 54 and a ground prong 58, see FIG. 4. The prongs 52, 54 and 58 can have various standardized known configurations for connecting, for example, to a plug on a power cable (not shown) which supplies AC power to electronic equipment (not shown) via the receptacle 56 and rocker switch 16. In general and to more clearly depict the present invention the connection of the prongs to electronic equipment which do not have associated contacts of the rocker switch 16 are not depicted, but one skilled in the art would understand that such connections are to be provided. Also the second prong 54 can be connected in a similar fashion to a second pair of electrical contacts in the rocker switch, whereby the rocker switch then has a double pole configuration. The rocker switch 16 is contained in a first section 60 of a housing 62 and the receptacle 56 is contained in a second section 64 of the housing 62. A center wall 66 separates the first and second sections 60, 64 of the housing 62. The first end 50 of the first prong 52 extends through the wall 66, first ends of the second prong 54 and the ground prong 58 also extending through the wall 66. In the embodiment depicted in FIG. 3 an electrical terminal 68 is connected to the ground prong 58 and is not part of the rocker switch 16. Alternatively, the ground prong 58 could be attached to a third set of electrical contacts if the rocker switch has a triple pole configuration. The section 64 has an open end 70 to allow connection of an electrical cable to the prongs of the receptacle 56.

Figure 5:
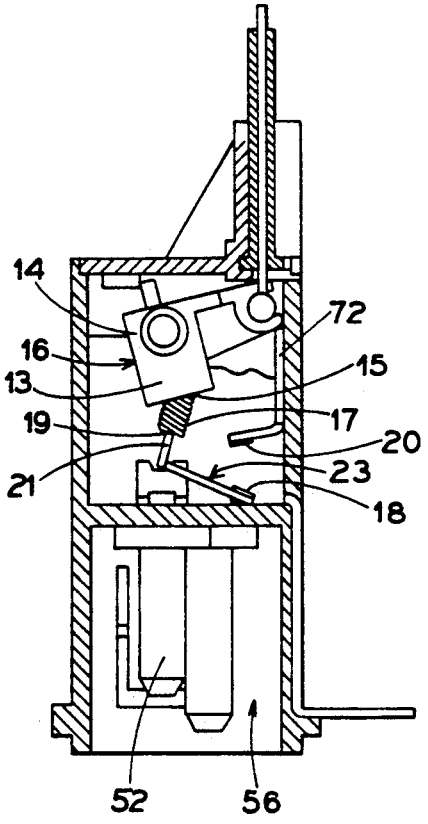
FIGS. 5 and 6 are cross-sectional views depicting switching positions of the FIG. 3 switch.
Figure 6:
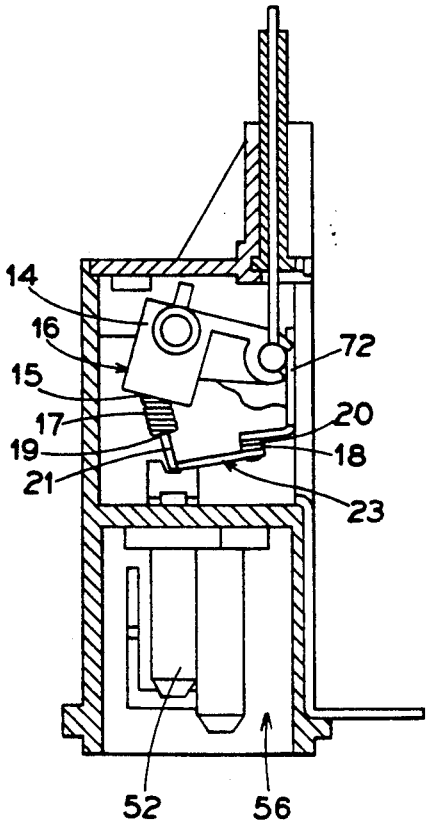
Figure 8D:
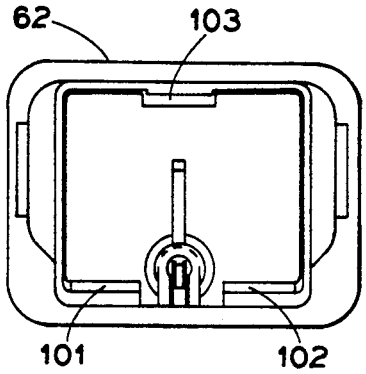
FIGS. 8A–8D depict an alternative embodiment of the present invention.
Figure 8A:
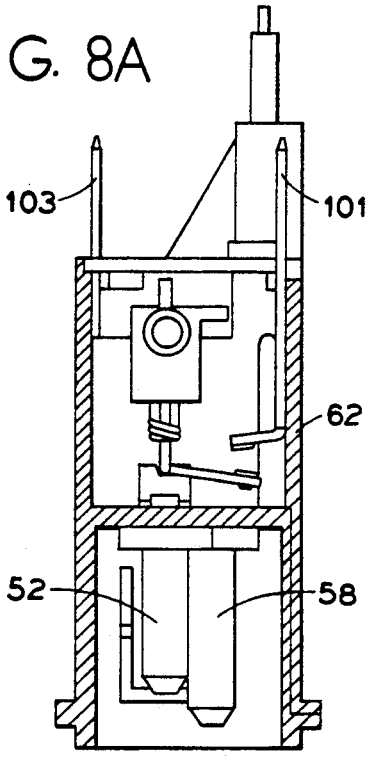
Figure 8B:
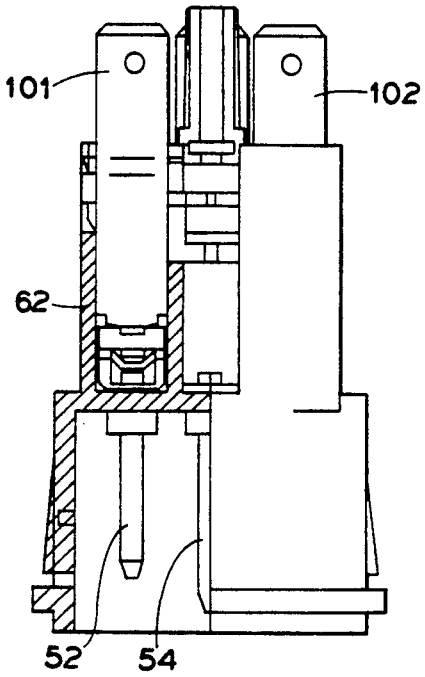
Figure 8C:
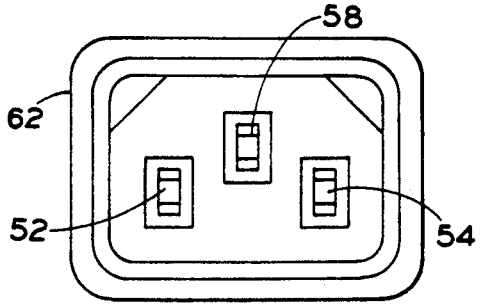
Figure 9D:
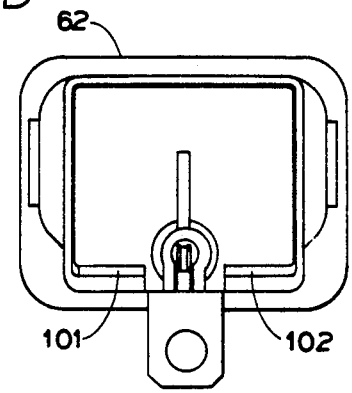
FIGS. 9A–9D depict another alternative embodiment of the present invention.
Figure 9A:
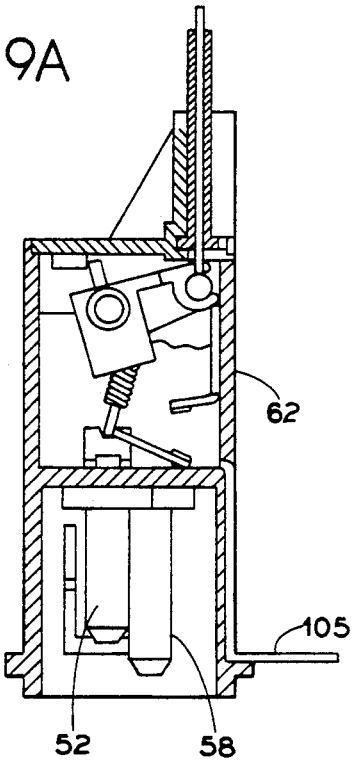
Figure 9B:
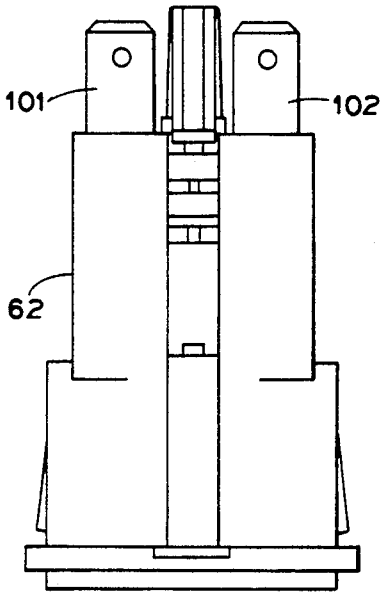
Figure 9C:
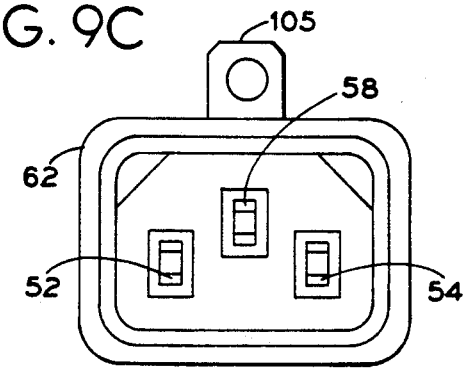
Figure 10D:
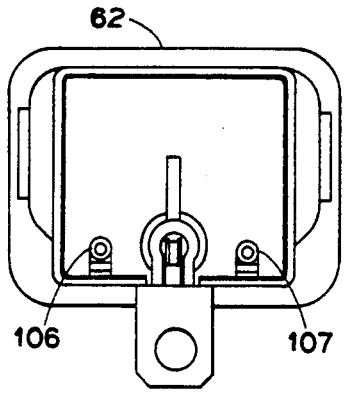
FIGS. 10A–10D depict yet another alternative embodiment of the present invention.
Figure 10A:
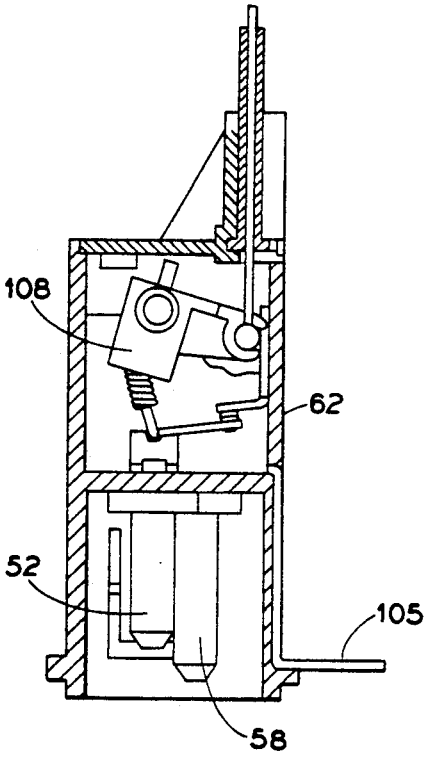
Figure 10B:
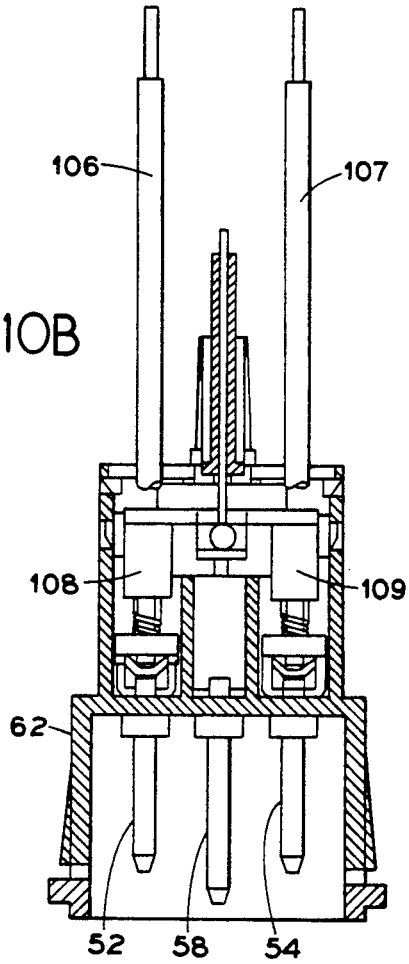
Figure 10C:
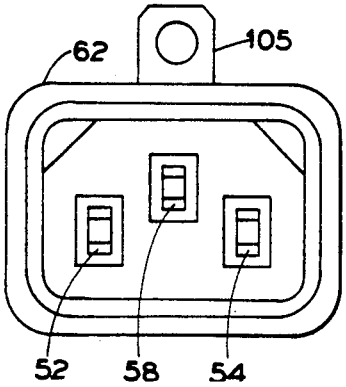

FIGS. 5 and 6 illustrate the operation of the rocker switch 16 in response to movement of the actuator 10. In a first switch position (FIG. 5) the electrical contacts 18, 20 are disconnected and the electrical path from the first prong 52 to a terminal 72 connected to the second contact 20 is broken. The terminal 72 may be electrical connected to a printed circuit board, for example in computer equipment. In such an application it is very important that the electrical path from the prong 52 to the first contact 18 be as short as possible to eliminate or reduce radio frequency interference. Also this structure requires a minimum of space on a housing panel of the computer equipment, since the rocker switch 16 is located behind the receptacle 56. Since the rocker switch 16 is remotely actuated, the actuator 10 can be mounted on the front of the computer, while the switch 16 and receptacle 56 have their housing 62 mounted on the rear of the computer. Obviously, many variations are possible and encompassed by the present invention. FIG. 6 illustrates a second switch position of the rocker switch 16 wherein the electrical contacts 18, 20 are contacting one another, thereby establishing an electrical path between the prong 52 and the terminal 72. In this embodiment the one piece movable actuator 14 has a hollow area 13 that contains one end 15 of a spring 17. A second end 19 of the spring 17 surrounds leg 21 of contact support 23. The contact support 23, which carries the first contact 18, is electrically and pivotally attached to the prong 52 as depicted in FIGS. 5 and 6. As the one piece movable actuator 14 is moved in a direction from one position to another, the spring 17 flexes thereby allowing the contact support 23 to move in an opposite direction.

Figure 7:
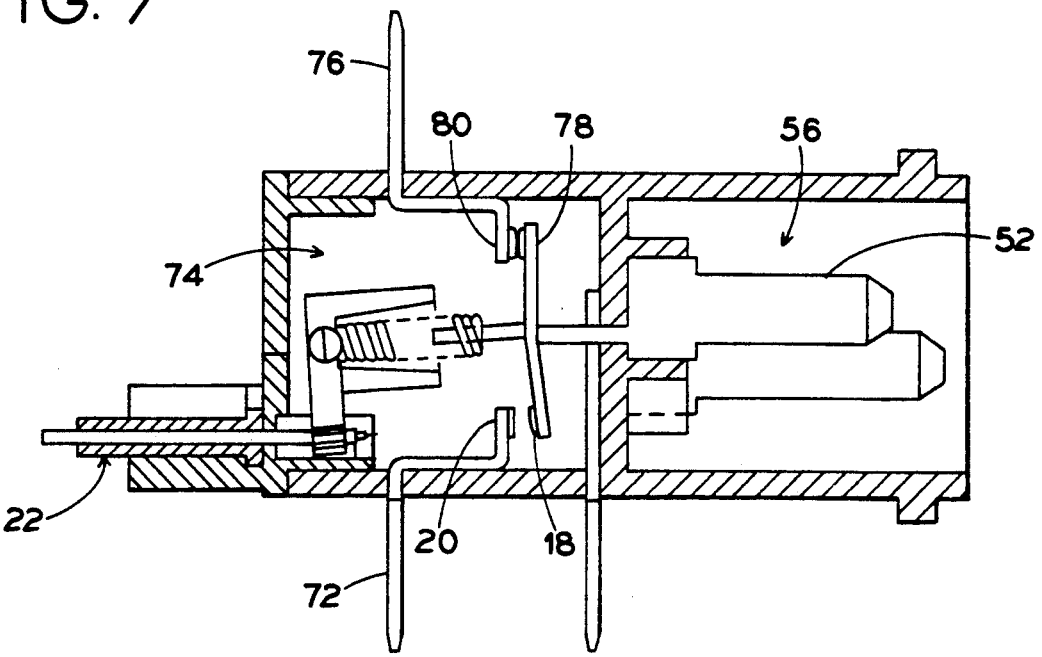
FIG. 7 is a cross-sectional view of a double pole version of the switch used in the present invention.

A double throw rocker switch 74 is shown in the alternative embodiment depicted in FIG. 7, the switch 74 being shown in a center position wherein the prong 52 in the receptacle 56 is not connected to either terminal 72 or terminal 76. In one switch position, the electrical contacts 18 and 20 contact one another and an electrical path is established between the prong 52 and the terminal 72. In the other switch position, electrical contacts 78 and 80 contact one another and an electrical path is established between the prong 52 and the terminal 76. The rocker switch 74 can have a double pole, double throw configuration for switching both prongs 52 and 54.

In general the type of switch used in the present invention can be referred to as a nonlinear motion switch, that is a switch having at least one part which moves in a nonlinear fashion. For example, a slide switch would not be considered a nonlinear motion switch.

Three different alternative embodiments of the present invention are depicted in FIGS. 8A-8D, FIGS. 9A-9D and FIGS. 10A-10D, respectively. It is a feature of the present invention that all three of these embodiments have a single one-piece housing for the rocker switch and the prongs that form the electrical plug. The rocker switch configuration can be, for example, a single-throw, single-pole as depicted in the embodiment of FIGS. 8A-8D, or a single-throw, double-pole as depicted in the embodiment of FIGS. 10A-10D.

In the FIGS. 8A-8D embodiment, three contacts 101, 102, 103 extend from a backside 104 of the housing 62 and are electrically connected to the prongs 52, 54 and 58, respectively. Prong 52 is connected to the contact 101 via the rocker switch 100. In the FIGS. 9A-9D embodiment, the ground prong 58 is electrically connected to a forward positioned grounding strip 105.

In FIGS. 10A–10D embodiment, lead wires 106, 107 extend from the backside 105 of the housing 62 and are electrically connected to respective prongs 52 and 54 via rocker switches 108, 198, respectively. The ground prong 58 is electrically connected to forward positioned grounding strip 105.

The invention is not limited to the particular details of the apparatus depicted and other modifications and applications are contemplated. Certain other changes may be make in the above described apparatus without departing from the true spirit and scope of the invention herein involved. It is intended, therefore, that the subject matter in the above depiction shall be interpreted as illustrative and not in a limiting sense.

What is claimed is:

1. A remotely controlled switch with receptacle termination assembly comprising:

a housing for providing a support having at least a first section and second section;

a nonlinear motion toggle switch located in said first section of said housing and having a one piece of movable activator for making and breaking an electrical connection between at least first and second electrical contacts;

an actuator for actuating said movable activator of said nonlinear motion toggle switch, said actuator having a movable section, said actuator having a body containing said movable section, said movable section rotatable about a pivot axis, said movable section having at least a first end;

a connection element for directly connecting said movable section of said actuator to said movable activator of said nonlinear motion toggle switch;

an electrical receptacle located in said second section of said housing, said receptacle having at least a first electrical prong which has a first end connected to said first electrical contact in said nonlinear motion toggle switch;

said connection element being an inner connector of a cable having an outer sheath containing said inner connector, a first end of said cable having said outer sheath removably attached to said body and having said inner connector removably connected to said first end of said movable section, and a second end of said cable being connected to said nonlinear motion toggle switch, the outer sheath being removably attached to said first section of said housing and the inner connector being removable attached to said movable activator;

wherein, when said movable section of said actuator is moved, said movable activator of said nonlinear motion toggle switch changes from at least one switch position to another switch position, thereby producing a connection or a disconnection between said first and second contacts of said nonlinear motion toggle switch.

2. The remotely controlled switch with receptacle termination assembly according to claim 1, wherein the first and second contacts of the nonlinear motion toggle switch form a first pair of contacts of a plurality of pairs of contacts and wherein said receptacle has at least a corresponding electrical prong of a plurality of prongs connected to a corresponding first contact in each of said pairs of contacts, each of said prongs having its respective first end extending into said first section.

3. The remotely controlled switch with receptacle termination assembly according to claim 2, wherein the nonlinear motion toggle switch is a double pole, single throw switch interfaced with the receptacle having at least two electrical prongs.

4. The remotely controlled switch with receptacle termination assembly according to claim 1, wherein:

said one piece movable activator, said nonlinear motion toggle switch and said receptacle having a common single housing.

5. A remotely controlled switch with receptacle termination assembly comprising:

a housing for providing a support having at least a first section and a second section;

a nonlinear motion toggle switch located in said first section of said housing and having a one piece movable activator for making and breaking an electrical connection between at least first and second electrical contacts;

an actuator for actuating said movable activator of said nonlinear toggle switch, said actuator having a body containing a movable section having at least a first end;

a cable for directly connecting said movable section of said actuator to said movable activator of said nonlinear motion toggle switch, said cable having an outer sheath containing an inner connector, a first end of said cable having said outer sheath attached to said body and having said inner connector connected to said first end of said movable section, a second end of said cable having said outer sheath attached to said first section of said housing and said inner connector attached to said movable activator;

an electrical receptacle located in said second section of said housing, said receptacle having at least a first electrical prong which has a first end connected to said first electrical contact in said nonlinear motion toggle switch;

when said movable section of said actuator is moved, said movable activator of said nonlinear motion toggle switch changing from at least one switch position to another switch position, thereby producing a connection or a disconnection between said first and second contacts of said nonlinear motion toggle switch;

the first and second contacts of the nonlinear motion toggle switch forming a first pair of contacts of a plurality of pairs of contacts and said receptacle having at least a corresponding electrical prong of a plurality of prongs connected to a corresponding first contact in each of said pairs of contacts, each of said prongs having its respective first end extending into said first section;

the nonlinear motion toggle switch being a double pole, double throw switch interfaced with the receptacle having at least two electrical prongs, said nonlinear motion toggle switch further having a third electrical contact for each pair of contacts, wherein in said switch position disconnecting said first and second electrical contacts, said first and third electrical contacts are connected.

6. The remotely controlled switch with receptacle termination assembly according to claim 5, wherein:

said housing is a single unit.

7. A remotely controlled switch with receptacle termination assembly comprising:

a housing for providing a support having at least a first section and second section;

a toggle action rocker switch located in said first section of said housing and having a one piece movable activator for making and breaking an electrical connection between at least first and second electrical contacts;

an actuator having a body containing at least one movable section having at least a first end;

a cable for directly connecting said movable section of said actuator to said movable activator of said toggle action rocker switch, said cable having an outer sheath containing an inner connector, a first end of said cable having said outer sheath attached to said body and having said inner connector connected to said first end of said movable section, a second end of said cable having said outer sheath attached to said first section of said housing and said inner connector attached to said movable activator;

an electrical receptacle located in said second section of said housing, said receptacle having at least a first electrical prong which has a first end connected to said first electrical contact in said toggle action rocker switch;

when said movable section of said actuator is moved, said movable activator of said toggle action rocker switch changing from at least one switch position to another switch position, thereby producing a connection or a disconnection between said first and second contacts of said toggle action rocker switch;

the first and second contacts of the toggle action rocker switch forming a first pair of contacts of a plurality of pairs of contacts and aid receptacle having at least a corresponding electrical prong of a plurality of prongs connected to a corresponding first contact in each of said pairs of contacts, each of said prongs having its respective first end extending into said first section;

the toggle action rocker switch being a double pole, double throw switch interfaced with the receptacle having at least two electrical prongs, said toggle action rocker switch further having a third electrical contact for each pair of contacts, wherein in said switch position disconnecting said first and second electrical contacts, said first and third electrical contacts are connected.

8. The remotely controlled switch with receptacle termination assembly according to claim 7, wherein:

said housing is a single unit.

9. A remotely controlled switch with receptacle termination assembly comprising:

a housing for providing a support having at least a first section and second section;

a toggle action rocker switch located in said first section of said housing and having a one piece movable activator for making and breaking an electrical connection between at least first and second electrical contacts, an actuator for actuating said movable activator of said toggle action rocker switch, said actuator having a movable section, said actuator having a body containing said movable section, said movable section rotatable about a pivot axis, said movable section having at least a first end;

a connection element for directly connecting said movable section of said actuator to said movable activator of said toggle action rocker switch;

an electrical receptacle located in said second section of said housing, said receptacle having at least a first electrical prong which has a first end connected to said first electrical contact in said toggle action rocker switch, said connection element being an inner connector of a cable having an outer sheath containing said inner connector, a first end of said cable having said outer sheath removably attached to said body and having said inner connector removably connected to said first end of said movable section, and a second end of said cable being connected to said toggle action rocker switch, the outer sheath being removably attached to said first section of said housing and the inner connector being removably attached to said movable activator;

wherein, when said movable section of said actuator is moved, said movable activator of said toggle action rocker switch changes from at least one switch position to another switch position, thereby producing a connection or a disconnection between said first and second contacts of said toggle action rocker switch.

10. The remotely controlled switch with receptacle termination assembly according to claim 9, wherein the first and second contacts of the toggle action rocker switch form a first pair of contacts of a plurality of pairs of contacts and wherein said receptacle has at least a corresponding electrical prong of a plurality of prongs connected to a corresponding first contact in each of said pairs of contacts, each of said prongs having its respective first end extending into said first section.

11. The remotely controlled switch with receptacle termination assembly according to claim 10, wherein the toggle action rocker switch is a double pole, single throw switch interfaced with the receptacle having at least two electrical prongs.

12. The remotely controlled switch with receptacle termination assembly according to claim 9, wherein:

said housing is a single unit.

* * * * *